US006305716B1

(12) United States Patent
Warther et al.

(10) Patent No.: US 6,305,716 B1
(45) Date of Patent: Oct. 23, 2001

(54) PRINTED SHEET PRODUCTS AND METHODS OF MAKING

(75) Inventors: Richard O. Warther, West Chester; Paul Jonathan Abbott, Exton; C. Raymond Steen, Jr., Chester Springs, all of PA (US)

(73) Assignee: Vanguard Identification Systems, Inc., West Chester, PA (US)

( * ) Notice: Subject to any disclaimer, the term of this patent is extended or adjusted under 35 U.S.C. 154(b) by 0 days.

(21) Appl. No.: 09/536,103

(22) Filed: Mar. 24, 2000

Related U.S. Application Data

(63) Continuation of application No. 09/102,423, filed on Jun. 22, 1998, now Pat. No. 6,039,356, which is a continuation of application No. 08/482,634, filed on Jun. 7, 1995, now Pat. No. 5,769,457, which is a continuation-in-part of application No. 08/191,975, filed on Feb. 4, 1994, now Pat. No. 5,495,881, which is a continuation-in-part of application No. 07/628,236, filed on Dec. 17, 1990, now abandoned, which is a continuation-in-part of application No. 07/502,005, filed on Mar. 30, 1990, now Pat. No. 4,978,146.

(60) Provisional application No. 60/126,476, filed on Mar. 26, 1999.

(51) Int. Cl.[7] ..... B42D 15/00

(52) U.S. Cl. ..... 283/61; 283/82; 283/81

(58) Field of Search ..... 283/61, 62, 116, 283/117, 82, 81, 83; 428/42.2, 42.3, 43; 229/92.3, 92.8, 71

(56) References Cited

U.S. PATENT DOCUMENTS

| | | |
|---|---|---|
| 1,594,331 | 7/1926 | Henke . |
| 1,795,291 | 3/1931 | Dunn . |
| 1,957,374 | 5/1934 | Unger . |
| 2,098,164 | 11/1937 | Rice . |
| 2,256,399 | 9/1941 | MacHarg . |

(List continued on next page.)

FOREIGN PATENT DOCUMENTS

| | | |
|---|---|---|
| 776047 | 1/1968 | (CA) . |
| 0 024 344 | 8/1980 | (EP) . |
| 1594331 | 7/1970 | (FR) . |
| 2225001 | 10/1974 | (FR) . |
| 2557338 | 6/1985 | (FR) . |
| 1 548 588 | 7/1979 | (GB) . |
| 2 213 770 | 8/1989 | (GB) . |
| 2-265796 | 10/1990 | (JP) . |
| WO 84/04493 | 11/1984 | (WO) . |
| 89/07052 | 8/1989 | (WO) . |

OTHER PUBLICATIONS

Catalog sheet The Prodigy Label Printer™, Fargo Electronics Incorporated, Prairie, MN 1990, 2 sides.

H. Bailey and B. Wray, "Photographic Bar Code Labels", *Identification Journal, Jan./Feb. 1988, pp.* 16–19.

*Primary Examiner*—Willmon Fridie, Jr.

(74) *Attorney, Agent, or Firm*—Akin, Gump, Strauss, Hauer & Feld, L.L.P.

(57) ABSTRACT

Printed sheet products comprise a thin, flexible core having a pair of printable, opposing major planar sides. A set of variable data fields are printed on at least a first side of the core of each individual sheet product in bar format, character format, or both. At least two or more of the variable data fields of each set are printed with a numeric code unique to the set and individual sheet product. Each set of variable data fields may include another data field printed with either a name and mailing address or other, information uniquely associated with that numeric code or with locations to manually receive that data. Each individual sheet product is scored to at least define a plurality of removable elements, at least one of the elements containing a variable data field from the set printed on the individual sheet product. Each individual sheet product further includes at least one redeemable coupon defined by scoring to be removable from the remainder of the product. Each individual sheet product may also further define a removable label bearing one of the printed code fields and a layer of an exposable adhesive.

20 Claims, 8 Drawing Sheets

U.S. PATENT DOCUMENTS

| | | | | |
|---|---|---|---|---|
| 2,312,204 | | 2/1943 | Weindel Jr. . | |
| 2,326,939 | | 8/1943 | Grafsland . | |
| 2,357,641 | | 9/1944 | Evalt . | |
| 2,363,472 | | 11/1944 | Ritter . | |
| 2,557,338 | | 6/1951 | Caldwell . | |
| 2,578,548 | | 12/1951 | Histed . | |
| 2,616,612 | | 11/1952 | Guttman . | |
| 2,812,601 | | 11/1957 | Hines . | |
| 2,865,120 | | 12/1958 | Hines . | |
| 3,062,431 | | 11/1962 | Rabenold . | |
| 3,087,267 | | 4/1963 | Gustafson . | |
| 3,093,296 | | 6/1963 | Wood . | |
| 3,130,509 | | 4/1964 | Brooks . | |
| 3,140,818 | | 7/1964 | Sheldon . | |
| 3,211,470 | | 10/1965 | Wilson . | |
| 3,216,743 | | 11/1965 | Morrow et al. . | |
| 3,226,862 | | 1/1966 | Gabruk . | |
| 3,228,129 | | 1/1966 | Gwinn et al. . | |
| 3,230,649 | | 1/1966 | Karn . | |
| 3,350,799 | | 11/1967 | Japs . | |
| 3,461,581 | | 8/1969 | Hoffmann . | |
| 3,684,869 | | 8/1972 | Reiter . | |
| 3,808,718 | | 5/1974 | Christiansen . | |
| 3,895,220 | | 7/1975 | Nelson et al. . | |
| 3,946,507 | | 3/1976 | Fergg et al. . | |
| 3,950,870 | | 4/1976 | Heegaard . | |
| 3,963,124 | | 6/1976 | Banks . | |
| 3,995,087 | | 11/1976 | Desanzo . | |
| 3,999,700 | | 12/1976 | Chalmers . | |
| 4,109,143 | | 8/1978 | Yamaguchi et al. . | |
| 4,149,305 | | 4/1979 | Blumhof . | |
| 4,214,463 | | 7/1980 | Blumhof . | |
| 4,306,433 | | 12/1981 | Kelly . | |
| 4,425,772 | | 1/1984 | Brewer . | |
| 4,521,981 | | 6/1985 | Kasprzycki et al. . | |
| 4,594,125 | | 6/1986 | Watson . | |
| 4,746,830 | | 5/1988 | Holland . | |
| 4,765,653 | | 8/1988 | Fasham et al. . | |
| 4,824,142 | | 4/1989 | Dossche . | |
| 4,842,304 | | 6/1989 | Jones . | |
| 4,854,610 | | 8/1989 | Kwiatek . | |
| 4,869,946 | | 9/1989 | Clay . | |
| 4,887,763 | | 12/1989 | Sano . | |
| 4,889,367 | | 12/1989 | Miller . | |
| 4,904,853 | | 2/1990 | Yokokawa . | |
| 4,978,146 | * | 12/1990 | Warther et al. | 283/81 |
| 4,995,642 | | 2/1991 | Juszak et al. . | |
| 5,078,828 | | 1/1992 | Marglin . | |
| 5,114,187 | | 5/1992 | Branch . | |
| 5,165,726 | | 11/1992 | Talbott . | |
| 5,180,824 | | 1/1993 | Bauman et al. . | |
| 5,495,981 | * | 3/1996 | Warther et al. | 283/81 X |
| 5,531,482 | | 7/1996 | Blank | 283/67 |
| 5,769,457 | * | 6/1998 | Warther | 283/61 |
| 5,997,042 | | 12/1999 | Blank | 283/61 |
| 6,039,356 | * | 3/2000 | Warther et al. | 283/61 |
| 6,089,611 | | 7/2000 | Blank | 283/67 |

* cited by examiner

PRINTED SHEET PRODUCTS AND METHODS OF MAKING

CROSS-REFERENCE TO RELATED APPLICATIONS

This application claims the benefit of Provisional Patent Application No. 60/126,476, filed Mar. 26, 1999, which is a continuation of U.S. application No. 09/102,423, filed Jun. 22, 1998, now U.S. Pat. No. 6,039,356, which is a continuation of U.S. application Ser. No. 08/482,634, filed Jun. 7, 1995, now U.S. Pat. No. 5,769,457, which is a continuation-in-part of U.S. application Ser. No. 08/191,975, filed Feb. 4, 1994, now U.S. Pat. No. 5,495,981, which is a continuation-in-part of application Ser. No. 07/628,236, filed Dec. 17, 1990, now abandoned, which is a continuation-in-part of application Ser. No. 07/502,005, filed Mar. 30, 1990, now U.S. Pat. No. 4,978,146.

BACKGROUND OF THE INVENTION

The invention relates to printed sheet products for use as identification cards and the like and, in particular, to sets of uniquely encoded cards, tags, labels and other sheet elements.

A substantial market has developed in recent years for inexpensively manufactured, individually encoded, transaction cards for such uses as store credit cards, membership cards, I.D. cards, etc. The transaction cards typically bear the code in a bar format to permit automatic machine scanning of the card. Such cards typically are supplied in sets with one or more cards, labels, and tags, being supplied with each set and bearing the same individual code number.

Previously, it has taken many separate manufacturing steps to provide such sets. Perhaps the most efficient prior method has been printing in multiple steps, individual sheets of uniquely encoded, typically sequentially numbered, transaction cards, printing separate strips of release paper backed adhesive labels with the same, unique codes as the cards, in the same sequence of codes as the codes appear on the cards of the sheets, and attaching the strip(s) with the appropriate code numbers to each sheet with the labels adjoining the like coded card(s).

In practice, this apparently simple, straightforward method required several labor-intensive steps. The appropriate labels for each sheet of cards were identified and applied by hand to the sheet so that the labels properly adjoin the associated transaction cards. Because this was done by hand, considerable time and effort was spent checking the final product to assure accuracy. In addition, because the transaction card sheets and label strips were printed separately, more time was needed to complete the task if the same printer is used to print the transaction card sheet and label strips. Alternatively, several printers must be available to simultaneously print the cards and the strips.

The twin problems of relatively high cost and errors associated with hand production of sets of plural related printed elements, all bearing some code unique to each set of elements, and numerous printing steps were solved by U.S. Pat. No. 4,978,146.

The present invention is also directed to improvements to the sheet products originally described in that patent.

SUMMARY OF THE INVENTION

In one aspect, the invention is a printed sheet product comprising a thin planar core of flexible, printable material having first and second opposing major sides; a set of at least two separate variable data fields printed on a first major side of the core, at least one of the variable data fields of the set being a code field printed with a unique numeric code common to all variable data fields of the set with numeric codes printed on the core, the unique numeric code being printed in at least a bar code format, at least a second variable data field of the set being either a second code field printed with the unique numeric code or an identification code field printed with a unique name and address combination of an individual assigned the unique numeric code; at least one static graphic field printed on the first major planar side of the core in addition to the set of variable data fields and at least one static graphic field lacking the unique numeric code printed on the second major planar side of the core; a first covering permanently fixed to the first major planar side of the core overlying at least one printed code field of the set and at least part of the static graphic field, the first covering being sufficiently transparent to permit the unique numeric code printed in bar code format in the underlying code field and one static graphic field printed on the first side of the core to be read through the first covering; and scoring extending sufficiently through the core, the first covering and any other layers on the core, where present, to define at least three elements, separable by an end user from one another and any remainder of the printed sheet product, a first removable element bearing at least the first printed code field of the set and at least part of the first covering and another removable element in the form of a printed redeemable coupon bearing at least part of one of the first and second printed static graphic fields.

BRIEF DESCRIPTION OF THE DRAWINGS

The foregoing summary, as well as the following detailed description of the presently preferred embodiments of the invention, will be better understood when read in conjunction with the appended drawings. It should be understood, however, that this invention is not limited to the precise arrangements illustrated. In the drawings which are diagrammatic.

DETAILED DESCRIPTION OF PREFERRED EMBODIMENTS

U.S. application Ser. No. 09/102,423, filed Jun. 22, 1998, U.S. Pat. Nos. 5,863,076, 5,769,457, 5,743,567, 5,495,981 and 4,978,146 and U.S. application Ser. No. 07/628,236, filed Dec. 17, 1990, now abandoned, are all incorporated by reference herein in their entirety as if fully set forth herein.

Figure 1:
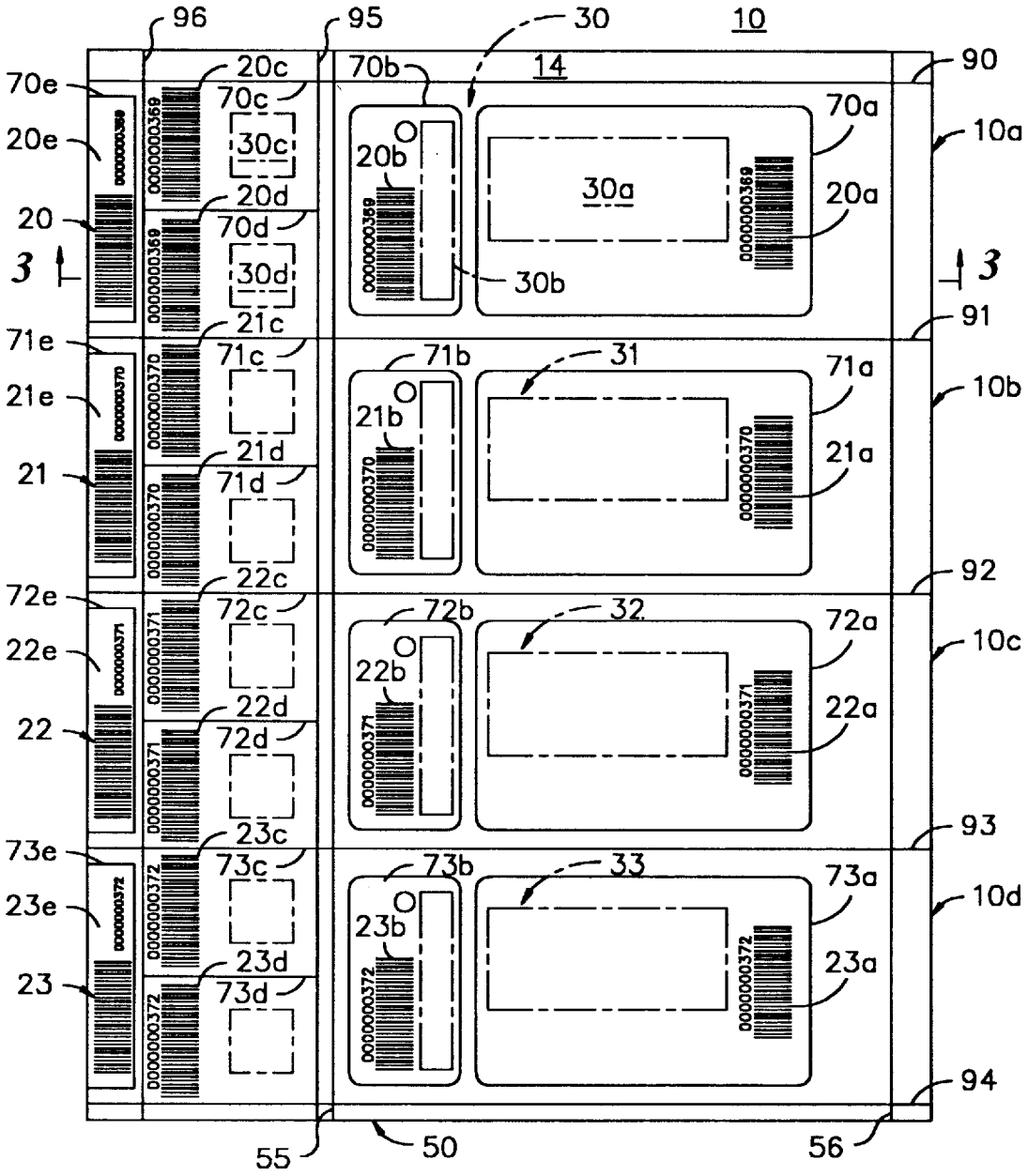
FIG. 1 is a front elevation of a first major planar side of a first example printed sheet product of the invention.
Figure 2:
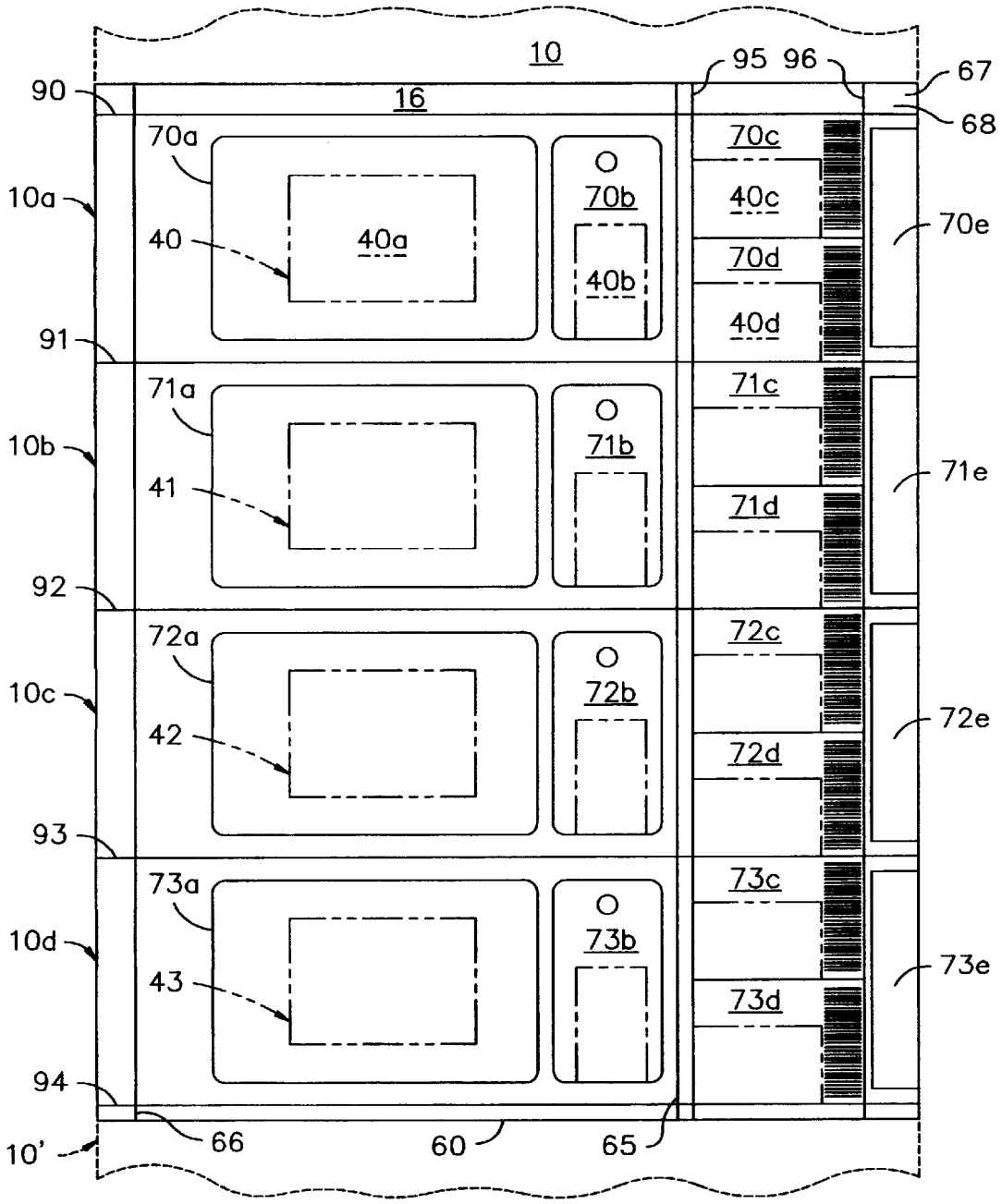
FIG. 2 is a front elevation of a second major planar side of the sheet product of FIG. 1.
Figure 3:
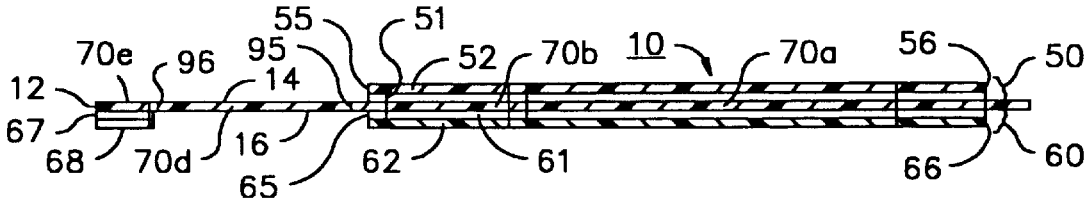
FIG. 3 is a cross section taken along the lines 3—3 in FIG. 1.

FIGS. 1 and 2 depict opposing major planar sides of a first example printed sheet product of the present invention indicated generally at 10. The product 10 includes a thin, flexible core 12 (see FIG. 3) of flexible, printable material which is, in this embodiment, the size of the product 10 depicted in FIGS. 1 and 2 and which has two opposing major planar sides 14 and 16. Core sides 14 and 16 effectively form the imprinted sides of the product 10 as well. Thus, core side 14 is depicted in FIG. 1 while core side 16 is depicted in FIG. 2.

Sheet product 10 may be a final sheet product, the manufacture of which has been completed and which will be sent in its depicted form for ultimate distribution and use, or it may be an intermediate sheet product, which is divided into smaller, individual sheet products indicated at 10*a,* 10*b,* 10*c* and 10*d* in FIGS. 1 and 2 with product 10*a* shown alone in FIG. 4, preferably by a final scoring step as will be described.

Referring to FIG. 1, there is printed on the first major side 14 of the core 12, a plurality of sets of variable data fields. Sheet product 10 is thus a "multiset" sheet product. In the depicted product 10, four variable data field sets 20, 21, 22, 23 of five fields each are indicated. However, the total number of variable data field sets will be many more than four, typically tens to hundreds of thousands of variable data field sets are printed on long continuous core rolls or thousands of cut sheets like core 12 in sheet product 10. Variable data field sets with smaller, equal or larger numbers of variable data fields are possible. A first variable data field of each of the four code field sets 20–23 is identified generally at 20*a,* 21*a,* 22*a* and 23*a,* respectively. The second, third, fourth and fifth variable data fields of each of the four sets 20–23 are similarly indicated generally at 20*b* through 23*b,* 20*c* through 23*c,* 20*d* through 23*d* and 20*e* through 23*e,* respectively.

Each variable data field of a set (e.g., 20–23) is printed with data unique to the set in comparison to the data printed in each other set of each sheet product forming a complete collection. In sheet product 10, the variable data code fields are unique codes, examples of which are shown in FIG. 1. The code of each of the four sets 20–23 of code fields 20*a*–20*e,* 21*a*–21*e,* etc., is unique to the set and differs from the unique code of each of the remaining sets of code fields printed on the first side 14 of the core 12 and on similar sheet products, as noted above, which form a larger collection with the sheet product 10. In the depicted example, each code has ten decimal digits. The first three digits are sequential between 369 and 372. One or more of the final digits in each code can be check digits. For example, six code digits would provide one million unique codes (000000–999999). The ten digit codes are merely examples. More or fewer digits and even letters and other symbols can be incorporated into the codes, although it will be appreciated that letters and other symbols may not be usable in some code formats, for example, in some linear bar code formats. Also, although it is a preferred method of encoding, the unique codes need not be numerically sequential, merely uniquely identifiable from all other, otherwise identical sheet products forming the collection of such sheet products.

The unique code of each set of code fields is printed in at least a machine readable format and, preferably, in both machine readable bar and human readable numeral formats in each of the first (20*a*–23*a*), second (20*b*–23*b*), third (20*c*–23*c*) and fourth (20*d*–23*d*) code fields of each of the four sets 20–23 of code fields. The same unique code of the set preferably is printed in at least numeral format in the fifth code field 20*e* through 23*e* of each set of code fields or in both formats as indicated. Each individual code field 20*a,* 20*b,* etc. of each code field set 20, 21, 22, 23 is spaced from the other code fields of the set on the first side 14 of the core 12 and the sheet product 10 and each code field set 20–23 is organized and located on the sheet product 10 so that each set of code fields 20, 21, 22, 23 can be separated from one another and removed from a remainder of the sheet product 10 as another individual sheet product, an individual or "pack" sheet product, 10*a,* 10*b,* 10*c,* 10*d,* etc., which is intended to be distributed to a separate individual.

Also printed on the first side 14 of the core 12 are a first plurality of static graphic fields, represented by various dot and dashed blocks, indicated collectively at 30 through 33, respectively. Such fields typically contain text and/or symbolic design(s) that are not unique to each individual sheet product 10*a,* 10*b,* 10*c,* 10*d,* etc. In the depicted embodiment 10, each static graphic field 30–33 has four separate and discrete components, numbered individually only for the first field 30 as 30*a,* 30*b,* 30*c,* 30*d,* respectively. The static graphic fields 30–33 are preferably and typically identical to one another, but need not be so in all respects under certain conditions. Preferably, the number of static graphic fields 30–33 printed is at least equal the number of sets of code fields, in this case four, whereby each of the static graphic fields 30–33 is associated with a separate one of the code field sets 20–23 and individual sheet products 10*a,* 10*b,* 10*c,* 10*d.* Each of the code fields of each of the sets 20–23 is positioned substantially identically with respect to the static graphic fields 30–33 associated with all of the sets 20–23. For example, the first code field 20*a*–23*a* of each set of code fields is located in the same position with respect to the same part or component, e.g., 30*a* of static graphic field 30, in each of the other static graphic fields 31–33 for reasons which will be apparent. More particularly, each code field 20*a*–20*d* is located proximal a corresponding one of the static graphic field components 30*a*–30*d,* respectively.

Referring to FIG. 2, the second side 16 of the core 12 is preferably printed with a second plurality of static graphic fields, each field being indicated collectively at 40–43, respectively. Each of the second static graphic fields 40–43 in the depicted embodiment includes, for example, four separate components indicated by double dot dashed blocks. These are numbered individually only for the first static graphic field 40 as 40*a,* 40*b,* 40*c* and 40*d.* Preferably and typically, each of the second plurality of static graphic fields 40–43 is identical to one another and is associated with a separate one of the code field sets 20–23 and static graphic fields 30–33 on the first side 14. Thus, in each individual sheet product 10*a*–10*d* to be formed, each static graphic field 40–43, respectively, is positioned identically on the second side of the product in the same relative position opposite one of the sets of code fields 20–23 and one of the first static graphic fields 30–33. For example, components 40*a*–40*d* are preferably positioned directly opposite separate code fields 20*a*–20*d* of the first code field set 20 and components 30*a*–30*d* of the first set of static graphic fields 30. Only code field 20*e* does not immediately adjoin or back parts of the first or second static graphic fields 30, 40. Rather, it is located at a side edge of the product 10 to the side of the printed fields 30, 40. The details of the first plurality 30–33 and second plurality 40–43 of static graphic fields are generally immaterial to the invention with one important exception that will be subsequently discussed.

Preferably, after printing, there is applied to the first side 14 of the core 12, a first covering, which is indicated generally at 50. Its edges are identified at 55, 56 and can be seen in FIG. 3. The first covering 50 suggestedly covers at least part of the first side 14, overlying at least one and, according to preference, more than one of the printed code fields of each set 20–23. First covering 50 preferably also overlies at least part of the first static graphic fields 30–33 on the first side 14. The first covering 50 preferably extends entirely across the first side 14 sheet product 10 and each individual sheet product 10*a*–10*d* in only one of two mutually perpendicular directions (the vertical direction in the figures). In this embodiment, the first covering 50 is sufficiently wide to cover the first and second printed code fields 20*a*–23*a* and 20*b*–23*b* of all of the sets and components "1*a*" and "b" of the static graphic fields 30–33. Preferably, the covering 50 is at least sufficiently transparent to read the underlying printed fields 20*a*–23*a,* 20*b*–23*b* and 30–33. One of ordinary skill will appreciate that code fields can be "read" in various ways. The first covering is preferably sufficiently transparent in the visible light spectrum to permit human viewing as well as machine reading of the code fields. Unless otherwise qualified by "machine", the terms "reading" and "read" are intended to cover human viewing and machine reading. However, the first covering may be transparent only in some other spectrum, for example, the infrared spectrum. While not transparent to human visual examination (e.g. viewing), such a covering can be sufficiently transparent to known optical reader devices to permit reading of the machine readable representation of the unique code underlying the covering by such devices.

A second covering 60 with side edges 65, 66 is preferably applied to the second side 16 of the core 12 again permanently fixed to the second side 16 by lamination or other conventional method for the materials selected. Preferably, the second covering 60 extends entirely across the second side 16 of the sheet product 10 and each individual sheet product 10*a*–10*d* in only one of two mutually perpendicular directions, namely the vertical direction, and overlies only a portion of the second side 16 containing at least part of the second plurality of static graphic fields 40–43 printed on the second side. Preferably, the second covering is directly opposite the first covering 50 and underlies at least the first and second pluralities of code fields 20*a*–23*a* and 20*b*–23*b* and parts of the first plurality of printed static fields 30–33 associated with those code fields, i.e., the "a" and "b" components, respectively. Again, the second covering 60 is at least sufficiently transparent to at least machine read and, preferably view the underlying "a" and "b" components of the printed static graphic fields 40–43.

Also, preferably applied to the second side 16 of the core 12 is a layer, preferably a stripe, 67 of exposable pressure sensitive adhesive. Preferably, the stripe 67 is applied directly opposite the fifth code fields 20*e*–23*e*. In the embodiment of the invention 10 depicted in FIGS. 1 through 3, a release strip 68 directly overlies the stripe of pressure sensitive adhesive 67, which is partially broken away in the upper right corner of FIG. 2 to reveal adhesive layer 67. The strip 68 can be removed from the adhesive layer 67 to expose the adhesive stripe 67 when needed.

While any of a variety of materials, for example, as detailed in U.S. Pat. No. 4,978,146, may be used as components of the sheet product 10, it is preferred that the static graphic fields be offset or laser printed, that the variable data fields (code fields) be thermal transfer or laser printed, that the core material be compatible with the printing method and equipment selected and that the covering materials be compatible with the core materials. Preferably, core 12 is a microvoided polysilicate plastic sheet material having at least about sixty percent porosity (e.g., Teslin of PPG Industries). Preferably, each covering 50, 60 includes a solid film layer 51, 61, which is adhered to the core 12 by an adhesive layer 52, 62. Preferably, the adhesive layers can be activated in some way, for example, by heat, ultraviolet or visible light, to permanently bond the core 12 and cover sheets 50 and 60 together. The exposable, pressure sensitive adhesive layer 67 and release strip 68 could be, for example, the double coated, permanent adhesive transfer tape available from Enterprise Tape Company.

Preferably, after the above described printing and covering steps, the sheet product 10 is scored through the core 12 and, where present, the first covering 50, second covering 60, the adhesive layer 67 and release strip 68 and any other layers on the core 12. This scoring is indicated diagrammatically by bold solid lines 90–96 in FIGS. 1 and 2. While it is possible to distribute and use sheet products 10 in their indicated form, sheet products 10 are more conveniently reduced during the scoring step to individual sheet products 10*a*–10*d,* each of which includes one pack or set of removable elements, 70*a*–70*e*. Double thick, horizontal score lines 91–93 divide the original cut sheet product 10 into individual sheet products 10*a*–10*d,* respectively. Lines 90, 94 are trim lines while lines 95 and 96 and the unnumbered horizontal lines extending only between 95 and 96 are perforations. Alternatively, individual sheet products 10*a*–10*d* could be a part of a long continuous web sheet product 10', partially indicated in phantom containing hundreds or thousands of individual sheet products like 10*a*–10*d,* which are separated from one another and the remainder of the sheet product 10 or 10' in the scoring step (or an equivalent series of consecutive scoring steps at a final scoring station at the end of a production line). Other scoring is being indicated diagrammatically, as single thickness-continuous lines, as the exact type of scoring used, e.g., long, continuous cuts with short breaks, closely spaced perforations, etc. is a matter of choice. The single line scoring defines a plurality of sets of elements which remain with but are removable from the sheet product 10 or 10*a*–10*d*. In particular, four sets of removable elements, a number of sets equal to the numbers of sets of code fields 20–23, first plurality of static graphic fields 30–33 and second plurality of static graphic fields 40–43 printed on the core 12, are provided in product 10 by the scoring.

Each individual sheet product 10*a*–10*d* bears one set of the unique codes of the printed code field sets 20–23 and therefore can be used and distributed as a complete set to each different customer, potential customer or client of the end user.

Figure 4:
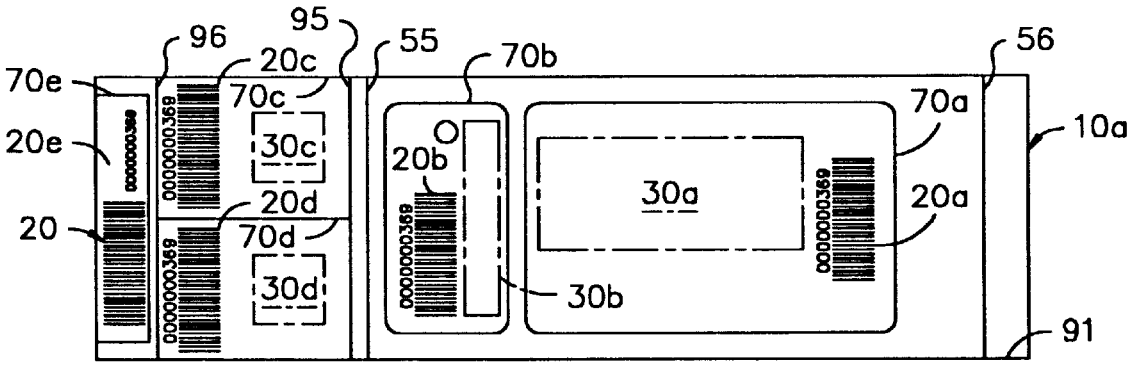
FIG. 4 is a front elevation of the first major planar side of an individual sheet product taken from the first sheet product of FIGS. 1 and 2.

The removable elements defined by scoring are identified separately in FIGS. 1, 2 and 4. According to the present invention, at least one removable element of each of the four sets of removable elements scored in sheet product 10 is a preferably generally rectangular, transaction element. In the depicted embodiment 10, two such elements are provided in each set: a transaction card element 70*a*–73*a,* which is the size of a traditional credit card (e.g., about 3⅜"×2⅛"), and a typically smaller, key tag element 70*b*–73*b,* which, in this case, is less than 3–×2" and suggestedly no greater than about 2½"×1" in size. Each of the elements 70*a*–73*a,* 70*b*–73*b* includes on one side, which is the second side 16 of the core 12 and product 10, a substantially identical portion of each of the second plurality of static graphic fields 40–43, which were printed on that side. Each element

70*a*–73*a,* 70*b*–73*b* also includes on its first side 14 of the core 12 and the sheet product 10, a separate, substantially identical portion of one of the first plurality of static graphic fields 30–33 (e.g., component 30*a* with 70*a,* 30*b* with 70*b,* etc.) and one of the first and second plurality of code fields (e.g., 20*a* with 70*a,* 20*b* with 70*b,* etc.) The elements 70*a*–73*a,* 70*b*–73*b* can be used as an identification card, membership card, transaction card, etc. A closed perimeter opening is further preferably scored through the sheet product 10 within each removable element 70*b*–73*b,* to permit the element 70*b*–73*b* to be mounted on a key chain or other key holder like a key or to receive a key chain or key ring or the like and be used as a key fob supporting one or more keys on such chain or ring or the like.

According to another important aspect of the invention, each set 70–73 of removable element includes at least one removable element in the form of a redeemable coupon. In the indicated sheet product embodiment 10, the scoring defines two removable printed redeemable coupons 70*c*–73*c* and 70*d*–73*d,* respectively, for each individual printed sheet product 10*a*–10*d.* As few as one and as many coupons as desired can be provided. The coupons may be identical, different, unique or some combination thereof. The term "redeemable coupon" refers to a removable element which is surrendered or redeemed in return for a free item or free service or an item or service at a reduced cost, or to purchase something and to get something else free or discounted, or any other form of coupon redemption previously known or which may be devised or come into favor in the future. The redeemable coupons 70*c*–73*c* of each set may include identical portions of the first static graphic fields 30–33 (i.e., portion 30*c*) and second static graphic fields 40–43 (i.e., portion 40*c*). The same is preferably true for coupons 70*d*–73*d* with the "d" components of the static graphic fields 30–33 and 40–43, respectively. As indicated, it is preferred that each coupon 70*c*–73*c* and 70*d*–73*d* further include one of the printed code fields 20*c*–23*c* and 20*d*–23*d,* respectively, but, the provision of such printed code fields is an option with respect to the coupons. If provided, they give the distributor of the individual sheet products 10*a*–10*d,* etc. a means of determining who has redeemed the coupon(s) given to them. They further require no added manufacturing steps as they are printed and scored during the same steps used to print the static graphic fields and score the other removable elements.

According to another aspect of the invention, the portions of the static graphic fields 30–33 and/or 40–43, which are printed on the removable coupon element 70*c*–73*c* and/or 70*d*–73*d,* preferably include a printed code suggestedly in bar only or bar and character formats, which are identical among each of the first coupon elements 70*c*–73*c* and among the second coupon elements 70*d*–73*d,* respectively, and which may be, for example, the Universal Product Code (UPC) of the particular item to which the coupon is directed in order to permit automatic scanning of the coupon for its redemption. For example, static graphic field components 40*c* and 40*d* may include a trademark or name of the product, its UPC in bar code and other static graphic material.

Each of the redeemable coupons 70*c*–73*c* and 70*d*–73*d* is preferably provided by a fully exposed section of the printed core 12. Suggestedly, each coupon 70*c*–73*c* and 70*d*–73*d* lacks any of the first covering 50 or second covering 60 as the coupons are single use items that do not require the protection afforded by such coverings. The coupons also suggestedly lack any of the adhesive layer 67, as such layer serves no function with respect to coupons. Of course, if desired, any coupon could be partially or completely covered by either or both of the first and second coverings and/or could bear part of such adhesive layer, or its own layer, if desired.

A fifth removable element of each set 70–73 is denoted at 70*e*–73*e* and includes a portion of the sheet product 10 having on one side, which was the first side 14 of the core 12 and product 10, the final (fifth) code fields 20*e*–23*e,* respectively of each set 20–23. Each removable element 70*e*–73*e* includes on its remaining side, which was the second side 16 of the core 12 and product 10, a portion of the stripe 67 of pressure sensitive adhesive and release strip 68. Elements 70*e*–73*e* can be used as labels on an application or membership form, etc., of the person receiving the remaining removable elements 70*a*–73*a* through 70*d*–73*d* of the set. If desired, the labels 70*e*–73*e* could have been positioned between the transaction elements 70*a*–73*a,* 70*b*–73*b* and the coupons 70*c*–73*c,* 70*d*–73*d* where at least the first side 14 of each label 70*e*–73*e* could have been overlapped and covered by first covering 50 applied over the code fields 20*a*–23*a* and 20*b*–23*b* of the transaction elements 70*a*–73*a,* 70*b*–73*b,* respectively, so that the printed code fields 20*e*–23*e* could also be protected. If desired or if easier for manufacture of particular sheet products, the labels 70*e*–73*e* could have been covered on their second sides 16 as well with the second covering 60 before the adhesive layer 67 and release strip 68 are applied over the covering. Preferably, first covering 50, second covering 60, exposable adhesive layer 67 and release strip 68 are all provided from roll stock in a continuous fashion along the appropriate side 14, 16 of the core 12 so as to extend completely along the height of products 10, 10', 10*a*–10*d,* etc.

Figure 5:
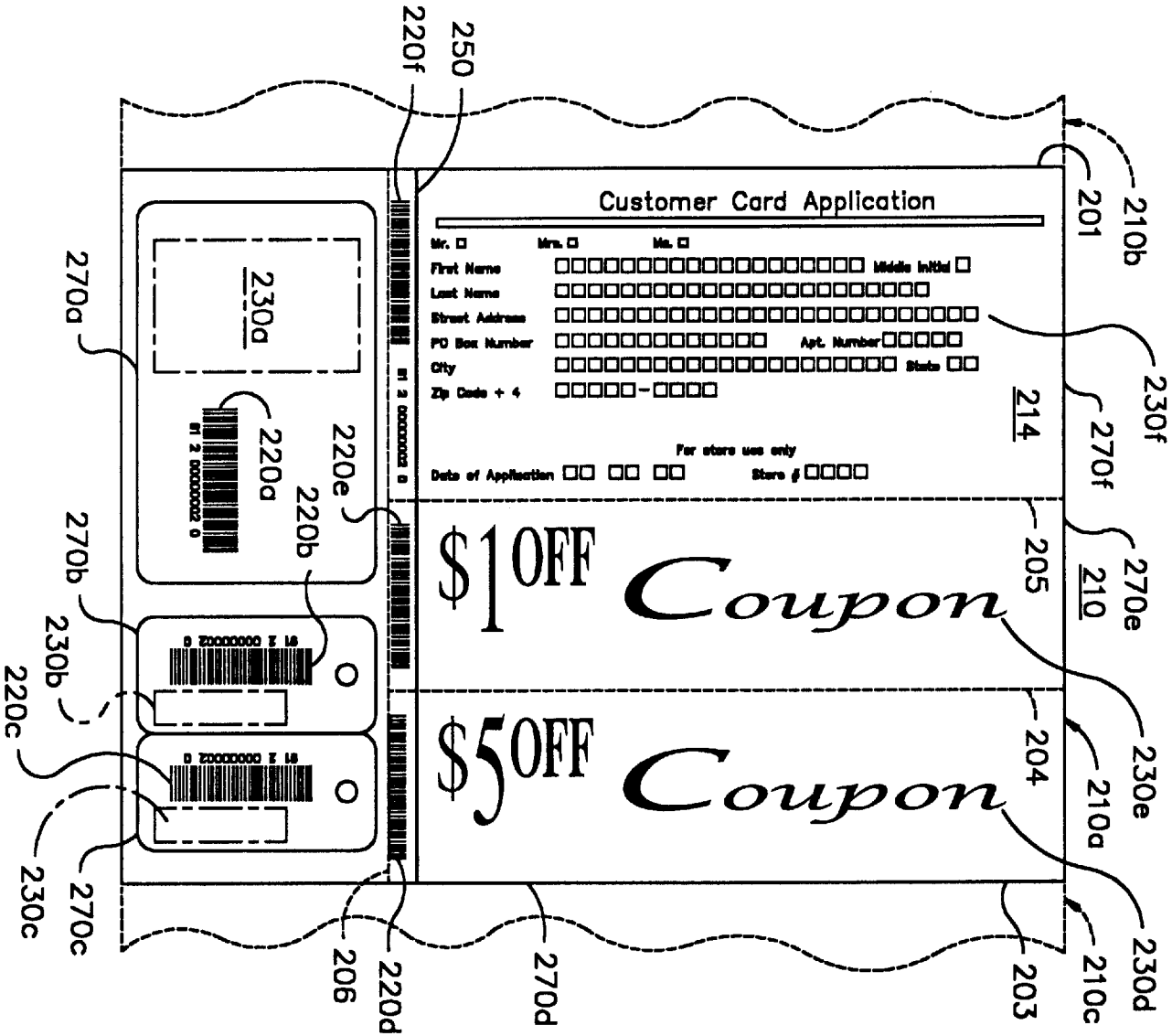
FIG. 5 is a front elevation of part of a first major planar side of a second example printed sheet product.
Figure 6:
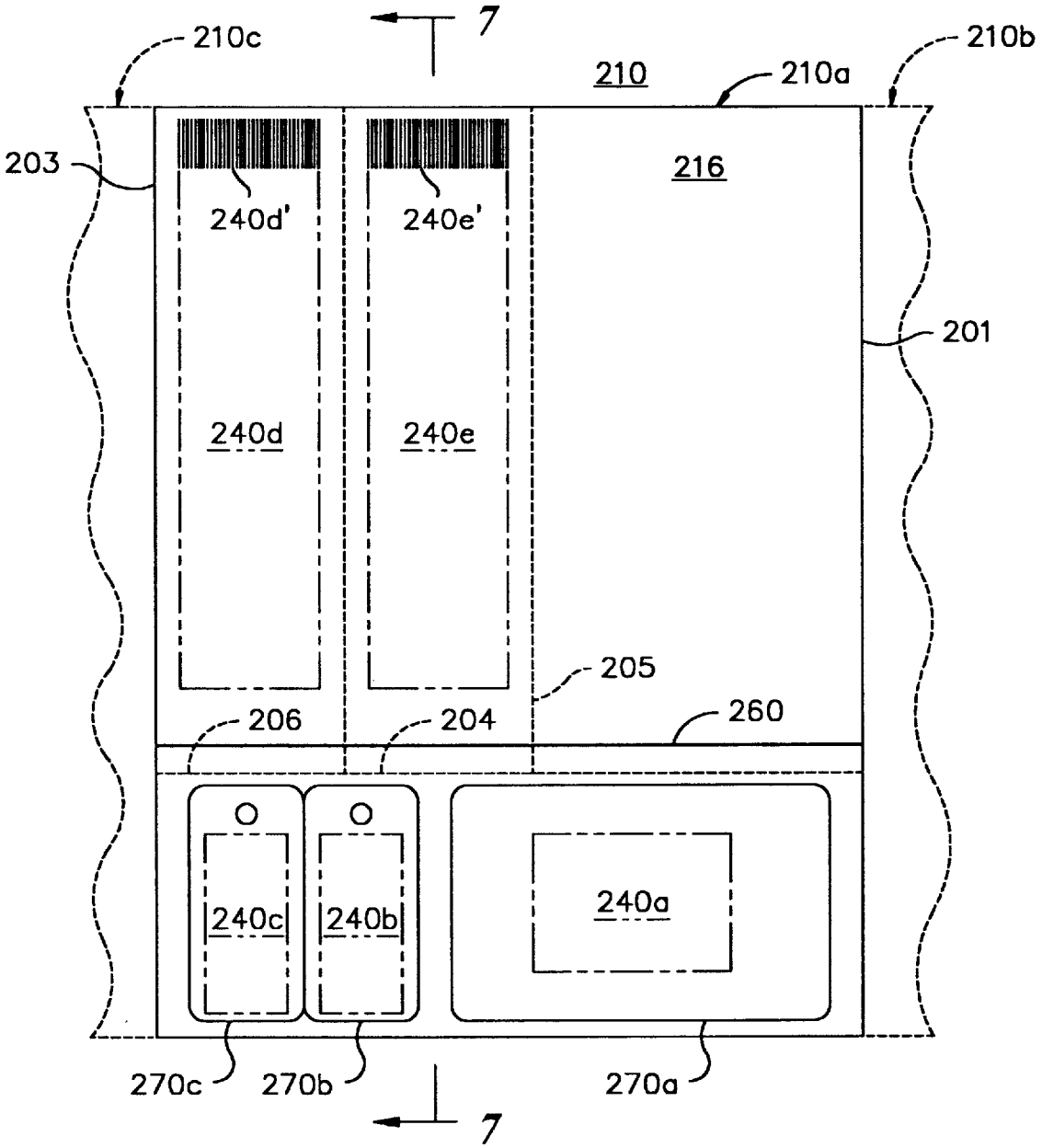
FIG. 6 is a rear elevation of a second, opposing major planar side of the sheet product of FIG. 5.
Figure 7:
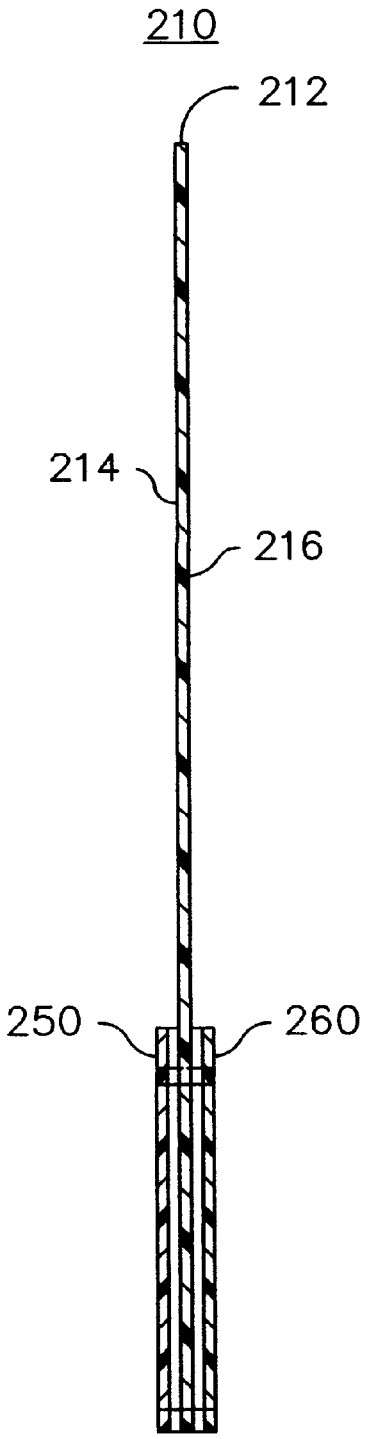
FIG. 7 is a cross section taken along the lines 7—7 in FIG. 6.

FIGS. 5 and 6 depict first and second major planar sides of a second printed sheet product of the present invention in the form of an "instant application" form indicated generally at 210*a* and seen in cross section in FIG. 7. The sheet product 210*a* again includes a thin, flexible printable planar core 212 which, again, is the size of the product 210*a* depicted in the figures and which has a pair of major planar opposing sides 214 and 216. There is printed on the first major planar side 214 of the core 212 a plurality of variable data fields 220*a*–220*f.* In the depicted sheet product 210, a set of four to six variable data fields is suggested but as few as two and more than six separate variable data fields could be printed for each set and sheet product 210*a,* which is and may be entirely fabricated as an individual sheet product like individual sheet product 10*a.* Alternatively, sheet product 210*a* may be part of a larger, continuous sheet product 210, parts of which are indicated in phantom on either side of individual sheet product 210*a* as 210*b* and 210*c.* Sheet product 210 may be a single cut sheet containing a few individual sheet products, i.e. 210*a,* 210*b,* 210*c,* or a continuous roll of hundreds or thousands of individual sheet products like 210*a.*

The individual sheet products 210*a,* 210*b,* 210*c,* etc. of such a collection of individual instant application form sheet products can be identical to one another but for the printed variable data fields, preferably code fields 220*a*–220*f* of each final sheet product 210*a.* The unique code printed in fields 220*a*–220*f* would again be identical to one another on each final, individual, application form sheet product 210*a* and different from the sets of printed code fields of each other final, individual application form sheet product of the collection, e.g., 210*b,* 210*c,* etc. Again, each of these variable data fields 220*a* through 220*f* preferably is printed with a unique code, preferably in both bar code and character formats. As with the previous individual sheet products 10*a,* etc., the unique code of each variable data field set 220 is unique to the set and individual sheet product 210*a* and different from the unique code of each other set of variable data fields printed on the first side 214 of the core 212 and each other individual sheet product 210*b,* 210*c,* etc. of the larger sheet product 210 and/or of the full collection of such individual sheet products. Again, each of the various individual variable data fields 220*a*–220*f* is spaced from one another so that each may be associated with a separate removable element of the individual sheet product 210*a*. In this embodiment, each of the unique codes in the variable data fields 220*a* through 220*f* is printed in the same direction but could be printed in directions transverse to one another, if desired.

The first side 214 of the core 212 of sheet product 210*a* is printed with a first static graphic field, the components of which are numbered collectively at 230*a*–230*f,* components 230*a*–230*c* being represented by the various dot and dash blocks. Such static graphic field again typically contains text and/or graphic design(s) which are repeated identically on each individual sheet product 210*a,* 210*b,* 210*c.* As was the case with the previously discussed embodiments, the second major planar side 216 of the core 212 of each individual sheet product 210*a* can be printed with a static graphic field backing any of the fields printed on the first side of the core depicted in FIG. 5. A static graphic field having components numbered collectively at 240*a*–240*e* in double dot dash block form are indicated in FIG. 6.

Preferably, a first covering 250 is applied over a portion of the first side 214 after printing the static graphic field 230 and the set of variable data fields 220 on the first side 214 and any other printing on either side of the core 212. In this particular sheet product 210*a,* the first covering 250 preferably covers only a portion of the sheet product 210 and overlies each of the variable data/code fields 220*a* through 220*f,* where provided. The printed variable data/code fields 220*e* and 220*f,* if provided, can be located so as to avoid being covered by the first covering, if desired. Again, the first covering 250 is preferably at least sufficiently transparent to machines, humans or preferably both to machine read and view all of the underlying printed variable data/code fields 220*a* through 220*f.* As was the case with sheet product 10 of FIGS. 1 through 3, a second covering 260 is preferably applied to the second major planar side 216 of the core 212 of the sheet product 210 directly opposite the first covering 250 and the variable data/code fields 220*a* through 220*f.* The second covering 260 again is sufficiently transparent to permit any variable data or static graphic field components 240*a*–240*c,* which may be printed on the second major planar side 216 of the core 212 beneath covering 260 to be machine read and viewed. Five components 240*a*–240*e* of an example static data field 240 are indicated by double dot dash blocks in FIG. 6. Coverings 250, 260 are suggestedly the same as coverings 50 and 60 applied in the same ways.

The sheet product 210*a* is preferably scored through its core 212 and, where present, the first covering 250, the second covering 260 and any other covering provided. The scoring is indicated diagrammatically by bold solid continuous lines. Score lines 201 and 203 define and separate the individual, instant application form 210*a* from adjoining individual sheet products 210*b,* 210*c* (in phantom), which would be made at the same time with sheet product 210*a* using the same continuous core 212, first covering 250 and second covering 260 and which would typically differ from each other individual sheet product 210*b,* 210*c* of the collection only in the unique codes printed in the code fields of the variable data field set of each individual sheet product 210*a,* etc.

The same scoring step preferably also defines six elements 270*a*–270*f* removable from the individual sheet product 210*a* by the end users. Preferably, three of the elements are transaction elements: a first, generally rectangular standard transaction card (i.e., credit card) size element 270*a* and two, usually smaller, preferably identical key tag elements 270*b* and 270*c* with closed perimeter openings extending through sheet product 210*a* and each element 270*b,* 270*c.* The scoring again further defines two redeemable coupons 270*d* and 270*e.* Lastly, the scoring identifies a preprinted customer application card 270*f* with preprinted headings to manually receive the name and address (and other information, if desired) concerning the person to whom the unique code and the other removable elements 270*a*–270*e* are given. Preferably, scored lines of perforations 204, 205 and 206 are used to releasably couple the coupons and card 270*d*–270*f* to one another and a remainder of the sheet product 210*a* releasably retaining the other three releasably removable transaction elements 270*a*–270*c.* Again, elements 270*a*–270*f* can include on a second side 216 of the core 212 of the individual sheet product 210*a,* a portion of any static graphic field components 240*a*–240*e,* which may be printed on that side of the core and sheet product in addition to a portion of the first static graphic field components 230*a*–240*f* printed on the first side 214 of the core 212 and sheet product 210*a.*

The particular format of the static graphic field of removable, customer application card element 270*f* is not important beyond the provision of the location to manually enter the identification (name and address) data. Suggestedly, a variable data field 220*f* with the unique code is provided as part of the removable card element 270*f* to assure correct identification of the unique code assigned to the individual identified manually on the application form element 270*f* and, if in bar code format, to permit scanning of the customer number for automatic machine reading. Variable data fields 220*d* and 220*e,* if provided, bear the same unique code as the other variable data sets 220*a*–220*c* and are optionally provided on either or both of two removable, redeemable coupons 270*d,* 270*e,* respectively. Again, the static graphic field components 230*d,* 230*e* or 240*d,* 240*e* of either or both coupon elements 270*d,* 270*e* can also be provided with a printed UPC (240*d'*, 240*e'*, respectively, in FIG. 6 ) in bar format (depicted) or character format or both, which would be unique to the item or transaction covered by the coupon and therefore identical among the various sheet products 210*a,* 210*b,* 210*c,* etc. forming the collection of individual sheet products.

As scored in FIGS. 5 and 6, each of the removable elements 270*d* through 270*f* includes part of the core 212, most of which is exposed except for a longitudinal edge portion which bears small parts of the first covering 250 and second covering 260 and code fields 220*d*–220*f,* if provided. The first and/or second coverings 250, 260 need not be extended so far away from the removable elements 270*a*–270*c* and towards the remaining elements 270*d*–270*f* to span any of the variable date fields 220*d*–220*f* or edge portions of the removable elements 270*d*–270*f.* If desired, the coverings may be completely omitted from one or more of those elements by appropriate location of the score lines defining the elements. Conversely any portion or all of the coupons can receive either or both of the outer coverings 250, 260. To the extent either covering overlaps the manual data entry area of the application form 270*f,* that surface of the covering should be roughened or otherwise treated to accept pencil or ink markings.

Figure 9:
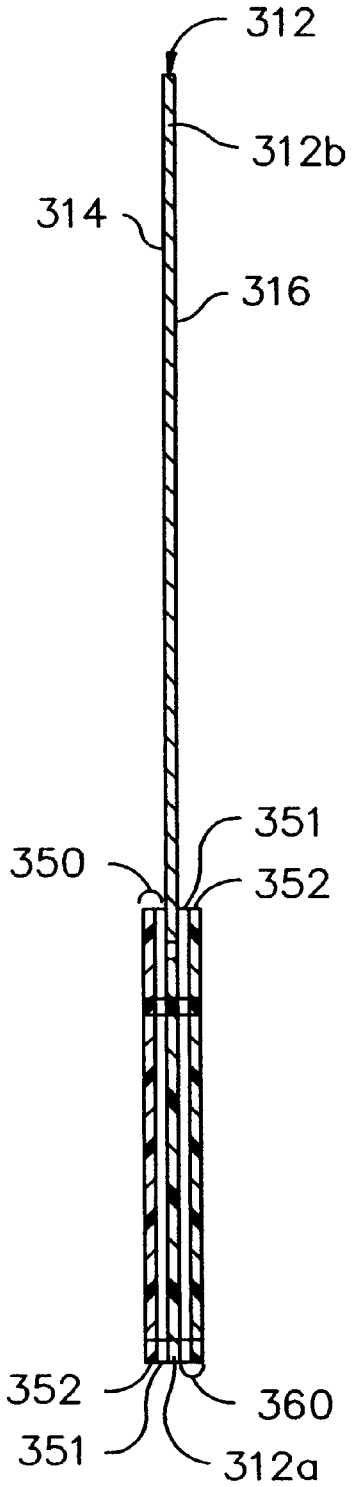
FIG. 9 is a cross section through the sheet product of FIG. 8 taken along the lines 9—9.
Figure 8:
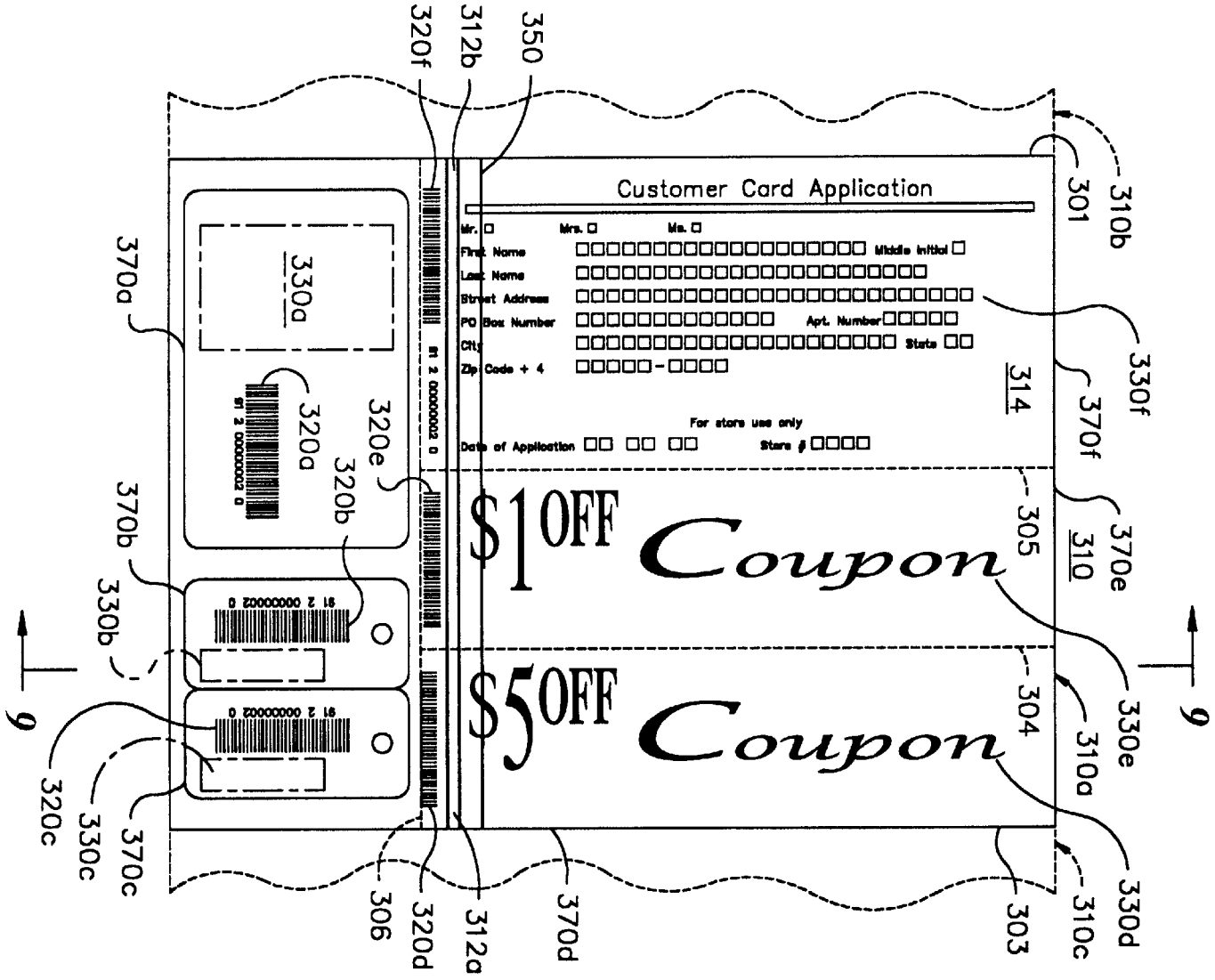
FIG. 8 is a front elevation of a first major planar side of a third example printed sheet product.

FIGS. 8 and 9 depict a slightly different version of the sheet product 210 of FIGS. 5 through 7, the components of which are identified by the same numbers assigned to comparable element in the second embodiment of FIGS. 5–7 but incremented by 100. Thus, all of the elements of sheet product 310*a* depicted in FIGS. 8 and 9 are functionally equivalent of their counterpart numbered elements in sheet product 210, except that the core 312 is actually composed of two separate individual core strips 312*a,* 312*b* of different, flexible, planar, printable sheet materials, which are joined together by one or both coverings 350, 360 or another adhesive tape member in the manner described in greater detail in U.S. Pat. No. 5,743,567. The reader is directed to that patent for further information. The significance of this embodiment 310*a* is that the bar coded material, which is used to form the removable transactional elements 370*a,* 370*b* and 370*c,* is a plastic material (e.g., the Teslin manufactured and supplied by PPG Industries), which is better suited than paper or cardboard to form a more enduring removable transaction element 370*a*–370*c,* while core strip 212*b* may be conventional paper stock, which is less expensive than the plastic materials, for the less used and/or less abused elements 370*d*–370*f.*

In addition, the sheet products 210*a,* 310*a* with redeemable coupons can be supplied with printed variable data fields including a printed name and address in place of a static printed customer card application form, with the name and address of the individual assigned the unique code of the printed code fields, so that the sheet product can be used directly as a mailer. Again, please refer to U.S. Pat. No. 5,743,567 and/or 5,769,457 for specifics regarding the possible material, equipment and steps that might be used to manufacture each of the three, above-described, exemplary embodiments or other similar embodiments.

Figure 10:
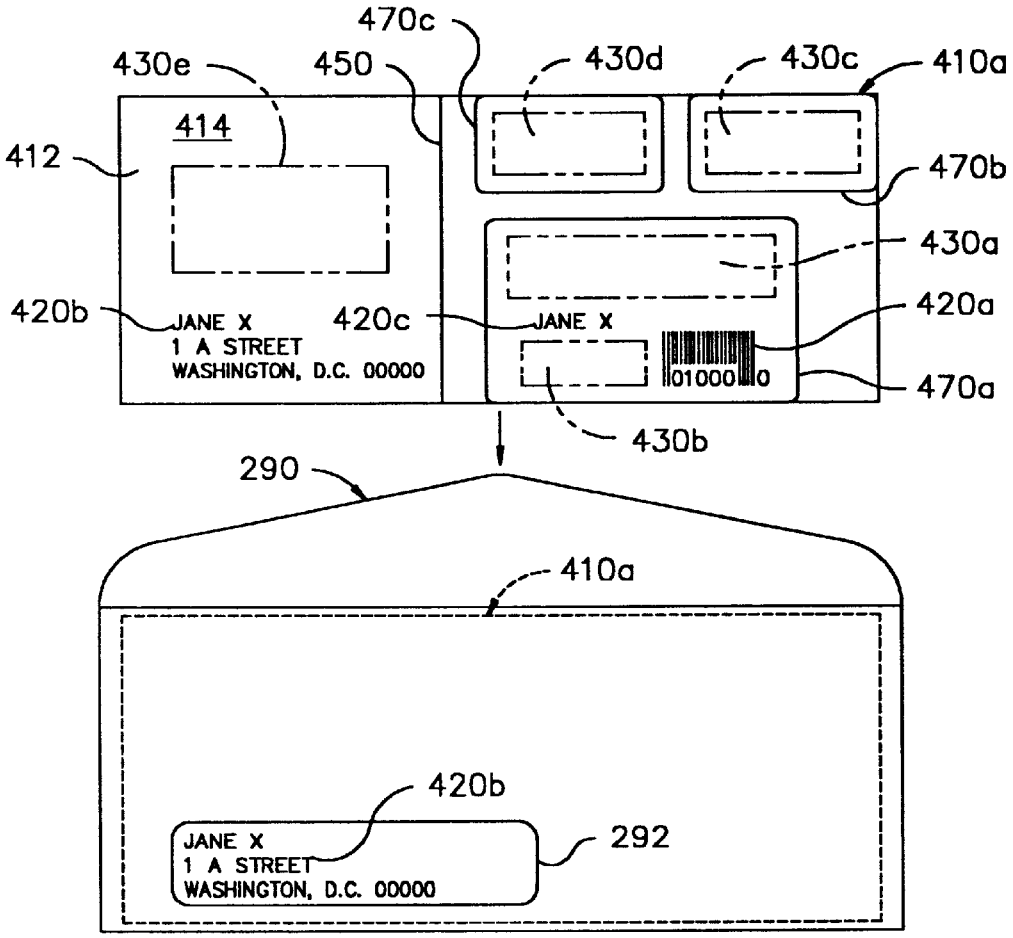
FIG. 10 depicts diagrammatically a mailer embodiment of the present invention being inserted into a standard size business envelope.
Figure 11:
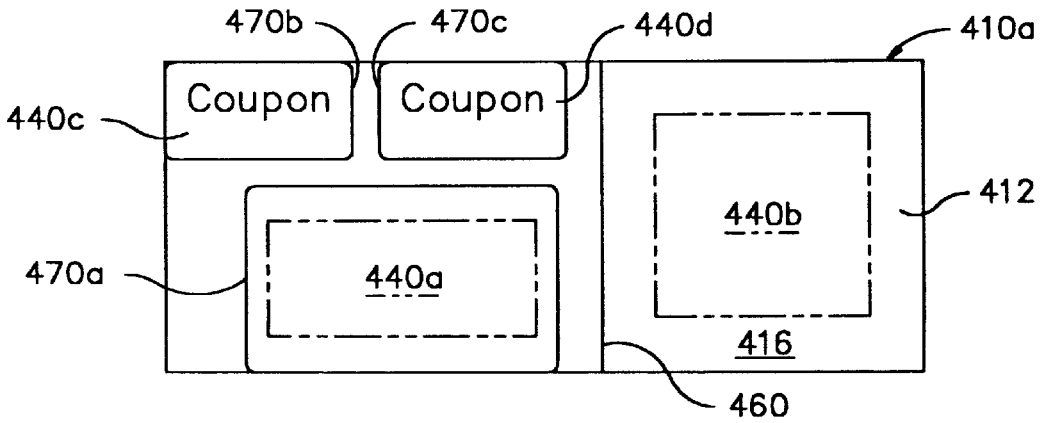
FIG. 11 depicts an opposite side view of the mailer sheet product of FIG. 10.

FIGS. 10 and 11 depict opposing sides of such an individual sheet product embodiment of the present invention in the form of a individual mailer 410 received in a standard size business envelope indicated generally at 290. Individual sheet product 410*a* again includes a thin flexible core 412, which is the size of the product 210*a* depicted in the figures and which has a pair of major planar opposing sides 414 seen in FIG. 10 and 416 seen in FIG. 11. There is printed on the first major planar side 414 a plurality of variable data fields 420*a*–420*b.* Individual sheet product 410*a* can be made with other substantially identical products on lengths of cut sheet like product 10 of FIG. 1 or in continuous web form like product 10' FIG. 2. Sheet product 410*a* has at least two variable data fields 420*a* and 420*b* printed on the first major planar side 414. The first variable data field 420*a* is printed with a unique code, preferably in both bar code and character formats, which is unique to individual sheet product 410*a*. The second variable data field 420*b* is the name and address of the unique individual to whom the unique code of variable data field 420*a* is assigned. Again, variable data field 420*b* is unique to the collection of individual sheet products of which 410*a* is one. A third data field 420*c* is provided. This data field may or may not be unique. If the individual's full address were added, it would be unique and an identification code field of the plurality of variable data fields. However, with only a name listed, there may be other similarly located data fields on the individual sheet products of the collection having the same name. Uniqueness of this particular data field, simply an individual's name, is possible but is not to be assured. If the name is, in fact, unique among the collection of individual sheet products with the same static graphic, fields, then it too is a variable data field. If not, it is simply another printed field but not a static graphic field as it does not appear on all of the other individual sheet products of the collection. First side 414 also includes a first static graphic field, the individual components of which are numbered collectively at 440*a*–440*e.* These would be identical in each individual sheet product of the collection. The opposite side 416 depicted in FIG. 11 bears a static graphic field having four indicated components 440*a*–440*d.*

Referring back to FIG. 10, a first covering 450 is applied over a portion of the first side 414 after printing the static graphic field and variable data fields on the first side of the core. Again, first covering 450 preferably only covers the first side 414 and one of its two mutually perpendicular directions. It further covers variable data fields 420*a,* 420*c* and static graphic field components 440*a*–440*d.* Referring to FIG. 11, a second cover sheet, the edge of which is indicated at 460 is applied over the static graphic field components 440*a,* 440*c* and 440*d* and extends in only one of the two mutually perpendicular directions of the sheet product 410*a.*

Sheet product 410*a* a preferably scored through its core 412 and, in this case, a first and second covering 450, 460 (as well as any other coverings which may be provided in that area). A scoring step defines elements 470*a*–470*c* removable from the individual sheet product 410*a* by any users. The first is a transaction element, preferably a generally rectangular standard transaction card (i.e., credit card) size element 470*a* and two redeemable coupons 470*b* and 470*c.* Because these coupons happen to be covered by the first and second coverings 450, 460, they are preferably held in the sheet product by thin material bridges between elongated, perforation. Variable data field 420*b* is printed in a location where it can be seen through window 292 in business envelope 290.

In an alternate embodiment (not depicted) both the name and address variable data field 420*b* and unique numeric code variable data field 420*a* can be printed proximal to one another so that both can be encompassed by score and delineating a conventional transaction (credit card) size removable element like element 470*a* but located on the left side of the individual sheet product so that the name and address again appears in the window 292 of the conventional business envelope 290. The first covering would extend over the left end of the side of the core bearing the variable data field while the second covering, if provided, would back the first covering. The coupons could then be printed on the right side of the front page away from the removable card element and the first and second coverings.

It should be understood that this invention is not limited to the particular embodiments disclosed, but is intended to cover any modifications which are within the scope and spirit of the invention as defined by the appended claims.

What is claimed is:

1. A printed sheet product comprising:

a thin planar core of flexible, printable material having first and second opposing major sides;

a set of at least two separate variable data fields printed on a first major side of the core, at least one of the variable data fields of the set being a code field printed with a unique numeric code common to all variable data fields of the set with numeric codes printed on the core, the unique numeric code being printed in at least a bar code format, at least a second variable data field of the set being either a second code field printed with the unique numeric code or an identification code field printed with a unique name and address combination of an individual assigned the unique numeric code;

at least one static graphic field printed on the first major side of the core in addition to the set of code fields;

at least one static graphic field printed on the second major side of the core;

a first covering permanently fixed to the first major side of the core overlying at least the unique numeric code of one printed variable data field of the set and at least part of one static graphic field on the first major side, the first covering being sufficiently transparent to permit the unique numeric code printed in the underlying one variable field and the static graphic field printed on the first side of the core to be read through the first covering; and scoring extending sufficiently through the core, the first covering and any other layers on the core, where present, to define at least three elements, separable by an end user from one another and any remainder of the printed sheet product, a first removable element bearing at least the first printed variable data field of the set and at least part of the first covering and another removable element in the form of a printed redeemable coupon bearing at least part of one of the printed first and second static graphic fields.

2. The printed sheet product of claim 1 further comprising:

an exposable adhesive layer on only a portion of a second side of the core and underlying only the second of the first and second printed variable data fields, at least part of the exposable adhesive layer being removable from a remainder of the sheet product on the second removable element to form a label.

3. The printed sheet product of claim 1 further comprising a second cover sheet permanently fixed to the second major planar side of the core underlying at least the first printed variable data field, the scoring extending through the second cover sheet such that at least a portion of the second cover sheet is removable with the first removable element, the first and second cover sheets fully covering opposing major sides of the first removable element.

4. The printed sheet product of claim 3 wherein the second cover sheet extends entirely across the remaining major side of the core in only one of two mutually perpendicular directions and underlies only the first of the first and second printed variable data fields of the set.

5. The printed sheet product of claim 4 wherein the first cover sheet extends entirely across the first side of the core in only one of two mutually perpendicular directions and covers only the first of the first and second printed variable data fields of the set.

6. The printed sheet product of claim 3 wherein at least one field is printed on the second major planar side of the core and at least part of the one printed field underlies the second cover sheet and wherein the second cover sheet is sufficiently transparent for at least the one printed field underlying the second cover sheet to be viewed through the second cover sheet.

7. The printed sheet product of claim 1 wherein the scoring further defines a fourth element removable from the sheet product and bearing a third printed variable data field of the set with the unique numeric code.

8. The printed sheet product of claim 1 wherein at least the first and fourth removable elements differ from one another in size.

9. The printed sheet product of claim 1 wherein the-scoring further forms a key ring hole defined by a closed perimeter opening extending transversely through the sheet product and through the first removable element.

10. The printed sheet product of claim 1 wherein the first removable element..further bears at least the printed name of a unique person assigned the unique numeric code.

11. The printed sheet product of claim 1 wherein the core is formed by a single layer of a single piece of the printable material.

12. The printed sheet product of claim 1 wherein the core is formed by a two separate pieces of flexible, planar printable sheet material joined together side by side to form a single layer.

13. The printed sheet product of claim 1 wherein the unique code printed in each code field of the set of variable data fields contains at least five decimal digits.

14. The printed sheet product of claim 1 wherein the first and second removable elements differ in size.

15. The printed sheet product of claim 1 wherein one removable element defined by the scoring is separable from at least the first and the third elements defined by the scoring and bears a printed static graphic field in the form of an application card with areas identified to receive a manually entered name and address of an individual assigned the unique numeric code for identification.

16. The printed sheet product of claim 1 wherein the removable coupon is printed with at least one numeric code in at least bar code format different from the unique code of the set printed in the first and second variable data fields.

17. The printed sheet product of claim 1 wherein at least one of the printed variable data fields of the sheet product includes a unique name and address combination identifying a person assigned the unique numeric code printed in the code fields of the product.

18. The printed sheet product of claim 1 being one individual sheet product of a collection of individual printed sheet products, printing on each individual printed sheet product of the collection being identical to printing on each other individual printed sheet product of the collection except for the unique codes of each of the printed code fields of the set of variable data fields of each sheet product of the collection, the unique code of the set of code fields printed on each individual sheet product of the collection differing from the unique code printed in the set of code fields of each other individual sheet, product of the collection, and for any person's name and address combination of any printed identification code fields of the set of variable data fields of each sheet product of the collection identifying the person assigned the unique code.

19. The collection of printed sheet products of claim 18 wherein the removable coupon of each sheet product is printed with at least one numeric code in at least bar code format different from the unique code printed in the variable data fields of the set of the sheet product but identical to the numeric code printed on the removable coupon of each other sheet product of the collection.

20. The collection of printed sheet products of claim 17 wherein each sheet product includes at least a fourth removable element in the form of a second printed redeemable coupon bearing at least part of one of the static graphic fields printed on the sheet product, the second coupon of each printed sheet product being identical to the second coupon of each other printed sheet product of the collection.

* * * * *